United States Patent [19]

Martin et al.

[11] 4,096,458

[45] Jun. 20, 1978

[54] HIGH FREQUENCY TRANSMISSION CABLE

[75] Inventors: Helmut Martin, Hanover; Otto Breitenbach, Nuremberg, both of Germany

[73] Assignee: Kabel-und Metallwerke Gutehoffnungshuette AG, Germany

[21] Appl. No.: 733,198

[22] Filed: Oct. 18, 1976

[30] Foreign Application Priority Data

Oct. 25, 1975 Germany ..... 2547806

[51] Int. Cl.[2] ..... H01P 5/00; H01P 3/06; H01P 3/00

[52] U.S. Cl. ..... 333/96; 333/84 R; 333/1

[58] Field of Search ..... 333/1, 84 R, 96, 97

[56] References Cited

U.S. PATENT DOCUMENTS

| | | | |
|---|---|---|---|
| 2,769,147 | 10/1956 | Black et al. | 333/96 |
| 2,769,150 | 10/1956 | Black et al. | 333/96 |
| 2,797,392 | 6/1957 | Clogston | 333/84 |
| 3,931,573 | 1/1976 | Hopfer | 324/106 |

*Primary Examiner*—Alfred E. Smith
*Assistant Examiner*—Harry E. Barlow
*Attorney, Agent, or Firm*—Marn & Jangarathis

[57] ABSTRACT

High frequency electrical cable is provided in accordance with the teachings of the instant invention wherein a plurality of conductors for transmitting information are contained in a common sheathing. Each of the plurality of conductors takes the form of a central core of insulating material upon which a layer of conductive material is rigidly disposed. The thickness of the layer of conductive material is such that current penetration is substantially independent of frequency within a given frequency range. Therefore, within this frequency range the attenuation characteristics of the resulting cable are substantially independent of frequency.

11 Claims, 3 Drawing Figures

HIGH FREQUENCY TRANSMISSION CABLE

This invention relates to electric cable for transmitting high frequency signals which includes a plurality of conductors and more particularly electric cable of the foregoing kind which exhibits frequency independent attenuation characteristics within a broad frequency range.

The frequency dependent nature of line constants and particularly the attenuation characteristics of high frequency communication cables is well known. In essence, the attenuation characteristics of high frequency communication cables tend to be a function of current penetration within the cable which causes the attenuation characteristics thereof to deviate from those which would otherwise be manifested by the concentration of current near the surface associated with skin effect. Thus, since both the skin effect and current penetration within a high frequency communication cable is a frequency dependent characteristic, the resulting attenuation characteristics exhibited per unit length by such communication cable is also frequency dependent.

This frequency dependence of the attenuation characteristics of high frequency communication cables is extremely disadvantageous because it makes the equalization of the line on a periodic basis an extremely complex and expensive procedure because the equalizers employed must exhibit a complementary frequency dependent attentuation characteristic to effectively carry out a linearization of the signal being conveyed by the various line sections or conductors within the multiconductor communication cable. Accordingly, equalizers which are currently employed to linearize the signals being conveyed on high frequency communication cables tend to be highly complex and costly equipments and this is particularly so where the same are employed to supply compensation for different line lengths without a distortion of the transmission time. For instance, extremely costly equipment must be installed on a periodic basis along the line length of high frequency communication cable which is utilized for carrier frequency and PCM communications to assure trouble free transmission. Thus, while the periodic restoration of a high frequency signal to a desired signal strength would represent little in the way of a problem if the communications cable exhibited a uniform attenuation characteristic with regard to frequency, since merely periodic amplification would be required; the frequency dependent attenuation characteristics currently exhibited thereby impose arduous equalization requirements on a periodic basis along the cable to assure trouble free transmission and therefor make the costs associated with such transmission facilities quite extensive.

Therefore, it is a principal object of the present invention to provide high frequency transmission cable which exhibits an attenuation characteristic which is substantially independent of requency whithin a broad frequency range. Other objects of the present invention will become apparent from a detailed description of an exemplary embodiment thereof which follows and the novel features of the present invention will be particularly pointed out in conjunction with the claims appended hereto.

In accordance with the teachings of the present invention, high frequency transmission cable is formed wherein each of a plurality of the individual conductors present within the cable is formed of a base core of insulating material upon which a layer of electrically conductive material is disposed; the electrically conductive material disposed on the base core of insulating material has a thickness t which is such that essentially no substantial current penetration occurs within a predetermined frequency range of the high frequency band width to be transmitted. In this manner, the resulting cable exhibits a substantially uniform attenuation characteristic within the frequency range and is highly advantageous in that the frequency range for which uniform attenuation characteristics are achieved is sufficiently wide to permit a high frequency transmission network to be constructed which, while requiring periodic amplification or repeater stations, does not require substantial equalization along the line while high quality transmission characteristics are retained. Thus, since no substantial equalization is required, the periodically required regeneration facilities may be simply structured and hence may be achieved with substantial cost reductions. In addition, the inventive cable set forth herein may be manufactured with substantial material savings when compared to the costs involved in solid conductors and in addition thereto the resulting cable exhibits markedly improved near end cross talk characteristics.

The invention will be more clearly understood by reference to the following detailed description of an exemplary embodiment thereof in conjunction with the accompanying drawings, in which.

Figure 1:
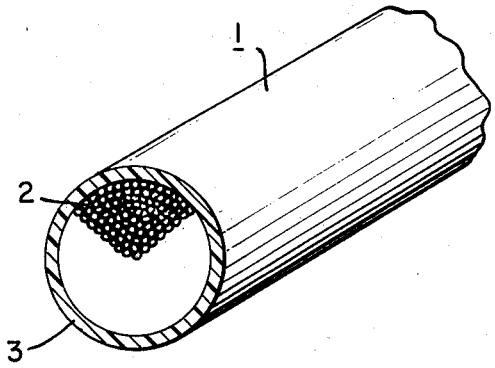
FIG. 1 is a pictorial view of high frequency cable constructed in accordance with the teachings of the instant invention.

Referring now to FIG. 1, there is shown an exemplary embodiment of high frequency cable in accordance with the teachings of the instant invention. The high frequncy cable 1 according to the instant invention may be employed for transmitting high frequency signals using known carrier frequency or PCM techniques. The high frequency cable 1 according to the instant invention comprises a plurality of central conductors 2 which are concentrated within a tight relationship in the interior of the cable 1 and are employed in the well known manner to convey individual high frequency signals therein. The group of individual conductors 2 is surrounded by an outer jacket 3 made of insulating material in the well known manner to form an insulated high frequency cable.

Figure 2:
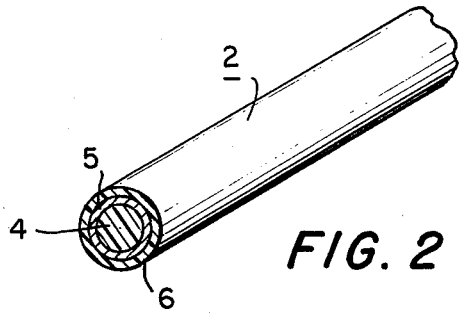
FIG. 2 illustrates in enlarged scale, an individual high frequency conductor employed within the cable depicted in FIG. 1.

Turning now to FIG. 2, the structure of each of the individual conductors 2 shown in FIG. 1 is illustrated in an enlarged scale to acquaint the reader with the full scope of the instant invention. More particularly, as shown in FIG. 2, each conductor within the group of conductors 2 comprises a central core 4 which may be formed of insulating material and is surrounded by a thin layer 5 of electrically conductive material such as copper, for example. The conductor is usually provided with an insulating outer cover 6 which may be formed of conventional materials.

The essence of the instant invention disclosed herein is that the thickness t of the thin layer 5 of electrically conductive material is calculated such that no current displacement occurs in a predetermined frequency range of the high frequency signals to be transmitted thereon so that the resulting cable 1 manifests a uniform attenuation characteristic. The core material 4 upon which the conductive layer is formed may be made of any sufficiently flexible plastic material which is suitable to carry and otherwise support the conductive layer formed thereon and is appropriate so that the conductive layer formed through a desired technique may be rigidly mounted thereon. The conductive layer 5 which may consist, for example, of copper or aluminum is rigidly mounted on the core material 4 and for this purpose a required thickness t may be deposited or otherwise formed by evaporation techniques in a vacuum. However, practice of the instant invention has shown that it is highly advantages to form the layer 5 of foil material which can be made true to size. The essence of the invention, however, resides in the thickness of the conductive layer 5.

In calculating the thickness of the conductive layer 5, certain simplifying assumptions may be made provided that the characteristic impedance and the transmission time of the line for the selective frequency range are almost constant and that the relationship $\omega\angle$ is much greater than R obtains wherein $\angle$ corresponds to the inductance and R corresponds to the resistance of the line. Thus, when these relationships obtain, the thickness of the conductive layer may be calculated in a simplified manner by ignoring the diameter of the conductors 2, the skin effect of adjacent conductors and the increased resistance associated wtih increasing eddy current losses in the adjacent conductors and in the cable sheath. Thus, assuming that these relationships obtain, the thickness of the conductive layer $t$ and the outer diameter $d_a$ of the conductor may be defined without great difficulty. More particularly, the thickness of the outer conductor may be determined as a function of the upper limit of the frequency band to be transmitted by the equation:

$$t = \tfrac{1}{2} \cdot u \cdot \delta. \tag{1}$$

In this equation $\delta$, the frequency dependent penetration depth is given by the equation:

$$\delta = 1/\sqrt{\pi \cdot K \cdot \mu_o \cdot f} \tag{2}$$

wherein $K$ = The conductivity of the material used;

$f$ = frequency;

$\mu_o$ = the magnetic field constant (susceptibility); and $u$ = the calculated argument based, upon a given permissible error from the equation:

$$\frac{R_1}{R_2} = \frac{u}{2} \cdot \frac{\text{Sinh } u - \text{Sin } u}{\text{Cosh } u - \text{Cos } u} \tag{3}$$

In equation 3, $R_1$ corresponds to the high frequency resistance and $R_2$ is the direct current resistance of the conductors.

The outer diameter $d_a$ of the conductor is dependent upon the lower limit of the frequency band to be transmitted as given by the equation:

$$d_a = \frac{10^5}{\pi^2 \cdot K \cdot t \cdot a \cdot f \cdot L} \tag{4}$$

wherein the constant $K$ is again the material dependent conductivity and values of resistance and inductance are given in terms of unit length. The factor a within equation 4 is calculated in proportion to the permissible deviation from the equation:

$$F = \frac{2}{a}(1 + a^2)^{\frac{1}{2}} \sin 0.5 \text{ arc tan } a - 1 \tag{5}$$

The foregoing equations enable the thickness of the electrically conductive material 5 encapsulating the base core 4 to be calculated for a predetermined frequency range so that current penetration is limited and the attendant current displacement resulting in a variable attenuation characteristic is avoided. For example, from equatiion 3 as set forth above and employing a permissible error of 5% in the deviation of constant values for the argument $u$, a value of 1.8 is obtained for the argument $u$, which may now be employed in equation 1. Similarly, since the material employed for the layer of conductive material 5 is known, the value of $\delta$ or the penetration depth may be calculated from equation 2. Once the value for the argument $u$ and the value of the penetration depth $\delta$ have been defined, equation 1 may be employed directly to obtain the thickness of the layer of electrical conductive material 5 for encapsulating the base core 4.

If the value defined for the layer thickness $t$ is small in comparison to the conductor diameter $d_a$, equation 5 may be employed to define factor a using a given permissible deviation of 5%. When this is done, equation 5 will yield a value for a of 0.45 so that the outer diameter $d_a$ of the conductor may now be defined directly from equation 4. In this manner, both the thickness $t$ of the layer of electrically conductive material 5 encapsulating the base core 4 may be defined together with the outer diameter $d_a$ of each conductor 2 employed within the embodiment of the inventive cable illustrated in FIG. 1 to thus fully define the parameters of each of the conductors 2 therein.

Figure 3:
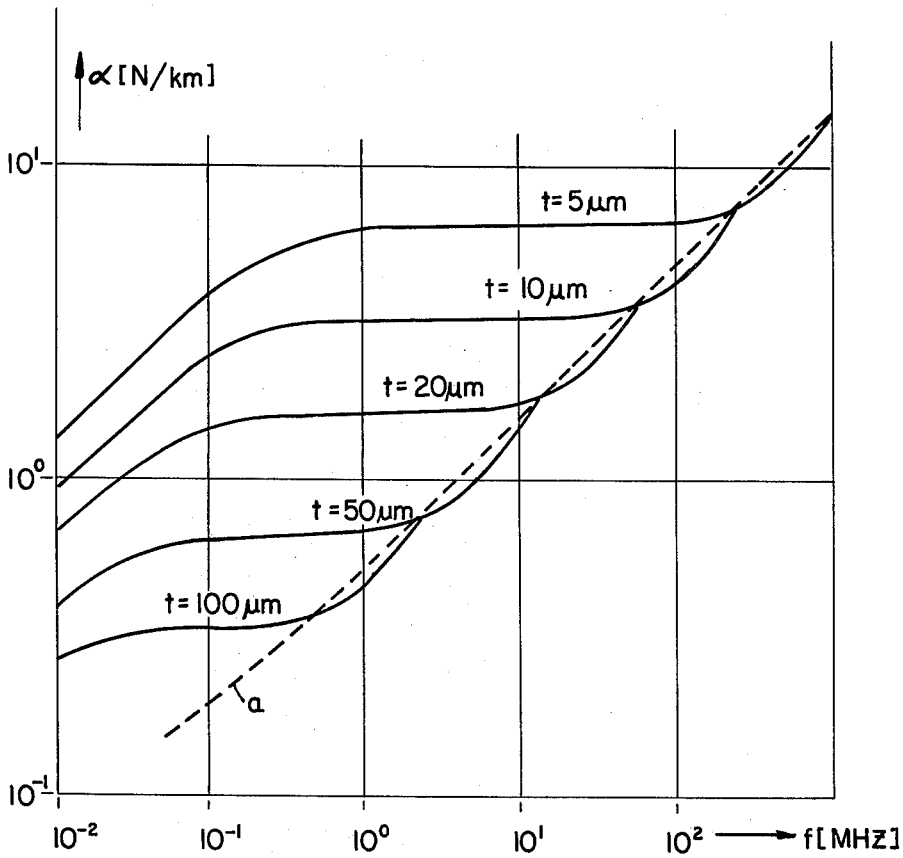
FIG. 3 shows exemplary attenuation curves for cable manufactured in accordance within the teachings of the instant invention.

The results obtained when cable is formed using the concepts of the instant invention are illustrated in an exemplary manner in FIG. 3. More particularly, FIG. 3 shows attenuation curves for conductors with thin conductive layers 5 encapsulating a base core in the manner illustrated in FIG. 2 wherein each of the curves illustrated are produced for conductors having an outer diameter ($d_a$) of 0.9 mm. In FIG. 3 the frequency in Mhz is plotted along the abcissa while the attenation $\alpha$ in nepers per kilometer is plotted along the ordinate and each curve illustrated in FIG. 3 has the thickness value $t$ associated therewith annotated thereon so that a range of thicknesses from 5$\mu$m to 100$\mu$m is illustrated in the five curves depicted, and each curve is associated, as aforesaid, with a conductor having the noted thickness and additionally having an outer diameter $d_a$ = 0.9mm.

Considering FIG. 3 it will be appreciated that for a conductor having a layer thickness of $t$=20$\mu$m, the attenuation characteristic exhibited will be substantially flat or independant of frequency between an upper frequency limit of about 10 Mhz and a lower frequency limit of about 100 khz. Thus, for this conductor, the attentuation is substantially constant between these two frequency ranges which is sufficiently broad in band width for high frequency communication operations. As will also be noted from FIG. 3, the range in which the attenuation characteristic of a conductor or frequency independent becomes wider with decreasing layer thickness and constant diameter so that higher frequency ranges may be designed for employing thinner thicknesses although attenuation levels, which are constant or frequency independent, are somewhat increased.

For the purposes of comparison with conventional cable, an attenuation curve for solid conductors having the same outer diameter has been superimposed in FIG. 3 in the form of the dashed curve annotated A. A comparison of the dashed curve A with the five curves for conductors formed in accordance with the teachings of the present invention and having the same diameter as aforesaid, will indicate that conventional solid conductors exhibit an attenuation characteristic which is frequency dependent in a directly proportional manner, while each of the conductors fabricated in accordance with the teachings of the instant invention exhibit a predeterminated frequency range wherein attenuation is independent of the frequency within that range. Thus, when communication cable is formed in accordance with the teachings of the instant invention and operated within the portion of the attenuation curve therefor which is substantially flat, it will be appreciated by those of ordinary skill in the art that attenuation which occurs along the line is independent of frequency and hence, repeater stations or the like need only supply appropriate amplification and perhaps a slight degree of equalization to restore this signal to a desired value; however, it is clearly not necessary to provide complex equalizers having a frequency dependent attenuation characteristic which is the complement of that which occurs on conventional high frequency cable.

Those of ordinary skill in the art will also appreciate that the formation of a thin conductive layer 5 on a flexible plastic carrier 4 in the manner taught by the instant invention accomplishes marked materials savings as well as achieving substantial operational savings in that equalizers having complex characteristics are not required. In addition, cable made in accordance with the teachings of the instant invention will display substantially improved near end cross talk characteristics when compared to cable formed of conventional solid conductors.

While the invention has been described in connection with an exemplary embodiment thereof it will be understood that many modifications will be readily apparent to those of ordinary skill in the art; and that this invention is intended to cover adaptations or variations thereof. Therefore, it is manifestly intended that this invention be only limited by the claims and equivalents thereof.

What is claimed is:

1. In electric cable for the transmission of high frequency signals which includes a plurality of individual signal conveying conductors forming a cable core and an outer sheath surrounding said cable core; the improvement comprising each of said plurality of individual signal conveying conductors being formed of a central core of insulating material having an electrically conductive layer disposed thereon, the thickness of said electrically conductive layer being such that within a predetermined frequency range current penetration is independent of frequency.

2. The improved electric cable according to claim 1 wherein said electrically conductive layer is rigidly formed upon said central core and has an insulating covering disposed thereon.

3. The improved electric cable according to claim 1 wherein said electrically conductive layer is formed upon said central core of insulating material by evaporating electrically conductive material onto said central core in a vacuum.

4. The improved electric cable according to claim 1 wherein said electrically conductive layer takes the form of foil material bonded to said central core.

5. The improved electric cable according to claim 1 wherein the thickness $t$ of said electrically conductive layer is determined as a function of the upper limit of the frequency band to be transmitted.

6. The improved electric cable according to claim 1 wherein each of said plurality of individual conductors has an outer diameter $d_a$ which is determined as a function of the lower limit of the frequency band to be transmitted.

7. The improved electric cable according to claim 6 wherein the outer diameter $d_a$ of each of said plurality of individual conductors is determined from the equation;

$$d_a = \frac{10^5}{\pi^2 K t a f L};$$

where $K$ is material dependent conductivity, impedance is set forth in values per unit length and the factor $a$ is calculated as proportional to a given permissible deviation from the equation:

$$F = \frac{2}{a}(1 + a^2)^{\frac{1}{2}} \sin 0.5 \text{ ARC TAN } a - 1.$$

8. The improved electric cable according to claim 5 wherein each of said plurality of individual conductors has an outer diameter $d_a$ which is determined as a function of the lower limit of the frequency band to be transmitted.

9. The improved electric cable according to claim 5 wherein the thickness $t$ of said electrically conductive layer is determined from the equation:

$$t = \tfrac{1}{2} u\delta;$$

wherein $\delta$ represents the frequency dependent penetration depth and is determined by the equation $$\delta = (\pi \cdot K \cdot \mu_o \cdot f)^{-\frac{1}{2}},$$

where $K$ is the conductivity of the material used, $f$ is the frequency, $\mu_o$ is the magnetic field constant (magnetic susceptibility); and $u$ is the argument calculated as based upon given permissible error from the equation:

$$\frac{R_1}{R_2} = \frac{u}{2} \cdot \frac{\text{Sinh } u - \text{Sin } u}{\text{Cosh } u - \text{Cos } u}$$

where $R_1$ is the high frequency resistance and $R_2$ is the direct current resistance of the conductors.

10. An improved communications line for high frequency application comprising:

a central core of insulating material; and an electrically conductive layer disposed on said central core, the thickness $t$ of said electrically conductive layer being determined as a function of the upper limit of the frequency band to be transmitted and being such that within a predetermined frequency range current penetration is indepenedent of frequency.

11. The improved electric cable according to claim 10 wherein the thickness $t$ of said electrically conductive layer is determined from the equation:

$$t = \tfrac{1}{2}\, u\delta;$$

wherein $\delta$ represents the frequency dependent penetration depth and is determined by the equation;

$$\delta = (\pi \cdot K \cdot \mu_o \cdot f)^{-\frac{1}{2}},$$

where $K$ is the conductivity of the material used, $f$ is the frequency, $\mu_o$ is the magnetic field constant (magnetic susceptibility); and $u$ is the argument calculated as based upon given permissible error from the equation:

$$\frac{R_1}{R_2} = \frac{u}{2} \cdot \frac{\text{Sinh } u - \text{Sin } u}{\text{Cosh } u - \text{Cos } u}$$

where $R_1$ is the high frequency resistance and $R_2$ is the direct current resistance of the conductors.

* * * * *